US008722949B2

(12) United States Patent
Horning et al.

(10) Patent No.: US 8,722,949 B2
(45) Date of Patent: May 13, 2014

(54) COAL LIQUEFACTION

(71) Applicant: Green Technology LLC, Walla Walla, WA (US)

(72) Inventors: John Lee Horning, Trabuco Canyon, CA (US); Jan H. Matthias, West Hollywood, CA (US); Nigel Moriarty, Lafayette, CA (US); John Stuart Lehde, Yamhill, OR (US)

(73) Assignee: Green Technology LLC, Walla Walla, WA (US)

( * ) Notice: Subject to any disclaimer, the term of this patent is extended or adjusted under 35 U.S.C. 154(b) by 0 days.

(21) Appl. No.: 14/066,373

(22) Filed: Oct. 29, 2013

(65) Prior Publication Data

US 2014/0048452 A1 Feb. 20, 2014

Related U.S. Application Data

(60) Continuation of application No. 13/625,970, filed on Sep. 25, 2012, now Pat. No. 8,597,470, which is a division of application No. 12/964,733, filed on Dec. 9, 2010, now Pat. No. 8,273,244.

(60) Provisional application No. 61/285,173, filed on Dec. 9, 2009.

(51) Int. Cl.
*C07C 1/00* (2006.01)

(52) U.S. Cl.
USPC ..... 585/240; 196/114; 196/120; 196/121

(58) Field of Classification Search
USPC ..... 585/240, 242; 208/402; 196/114, 120, 196/121; 204/155, 157.15, 164
See application file for complete search history.

(56) References Cited

U.S. PATENT DOCUMENTS

| | | | | |
|---|---|---|---|---|
| 3,312,141 | A | | 4/1967 | Cary |
| 4,010,089 | A | | 3/1977 | Stowell et al. |
| 4,067,390 | A | | 1/1978 | Camacho |
| 4,105,888 | A | * | 8/1978 | Fey ..... 219/121.36 |
| 4,344,839 | A | | 8/1982 | Pachkowski et al. |
| 4,358,629 | A | | 11/1982 | Kim |
| 4,487,693 | A | * | 12/1984 | Ito ..... 210/198.2 |
| 4,654,076 | A | * | 3/1987 | Camacho et al. ..... 75/10.19 |
| 4,788,082 | A | | 11/1988 | Schmitt |
| 4,788,379 | A | * | 11/1988 | Katz et al. ..... 585/809 |

(Continued)

OTHER PUBLICATIONS

Notice of Allowance for U.S. Appl. No. 12/964,733 mailed Jul. 31, 2012. (110).

(Continued)

*Primary Examiner* — Nina Bhat
(74) *Attorney, Agent, or Firm* — Hamilton, DeSanctis & Cha LLP

(57) ABSTRACT

Systems and methods for coal liquefaction are provided. According to one embodiment, coal is introduced into a plasma furnace. A plasma energy field is generated within the plasma furnace by causing an electrical discharge between a pair of arc rods located within the plasma furnace and positioned above the coal. Hydrocarbons contained within the coal are separated from the coal by causing the plasma energy field to penetrate the coal and heat the coal to a temperature sufficient to liquefy the hydrocarbons by focusing and drawing the plasma energy field through the coal with a magnetic field created proximate to the coal. The liquefied hydrocarbons are then captured.

9 Claims, 10 Drawing Sheets

(56) References Cited

U.S. PATENT DOCUMENTS

| | | | | |
|---|---|---|---|---|
| 5,892,311 | A | 4/1999 | Hayasaka | |
| 8,273,244 | B2 * | 9/2012 | Horning et al. | 208/402 |
| 8,597,470 | B2 * | 12/2013 | Horning et al. | 196/114 |
| 2004/0055538 | A1 | 3/2004 | Gorokhovsky | |
| 2008/0060978 | A1 | 3/2008 | Wegner | |
| 2009/0020456 | A1 | 1/2009 | Tsangaris et al. | |
| 2010/0258291 | A1 | 10/2010 | Everett De St. Remey et al. | |
| 2010/0307960 | A1 * | 12/2010 | Lissianski et al. | 208/402 |
| 2011/0132809 | A1 | 6/2011 | Horning | |

OTHER PUBLICATIONS

Final Rejection for U.S. Appl. No. 12/964,733 mailed Jul. 12, 2012. (110).

Non-Final Rejection for U.S. Appl. No. 12/964,733 mailed Jun. 19, 2012. (110).

Final Rejection for U.S. Appl. No. 12/964,733 mailed Apr. 17, 2012. (110).

Non-Final Rejection for U.S. Appl. No. 12/964,733 mailed Dec. 14, 2011. (110).

International Search Report and Written Opinion for PCT/US10/59784 mailed Mar. 21, 2011.

* cited by examiner

COAL LIQUEFACTION

CROSS-REFERENCE TO RELATED APPLICATIONS

This application is a continuation of U.S. patent application Ser. No. 13/625,970, filed on Sep. 25, 2012, now, U.S. Pat. No. 8,597,470, which is a divisional of U.S. patent application Ser. No. 12/964,733, filed on Dec. 9, 2010, now, U.S. Pat. No. 8,273,244, which claims the benefit of priority to U.S. Provisional Application No. 61/285,173, filed on Dec. 9, 2009, all of which are hereby incorporated by reference in their entirety for all purposes.

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever. Copyright© 2009-2013 Green Technology, LLC.

BACKGROUND

1. Field

Embodiments of the present invention generally relate to methods for recovering or extracting elements from organic and/or inorganic materials. The source materials may be naturally occurring, man-made, waste material, or any other suitable material, including, but not limited to complex or refractory ores, coal, crude oil, tar sands, shale and granite. Embodiments of the present invention are further directed to methods for separating and extracting desired recoverable materials, which are found in source materials, such as complex or refractory ores, into a pure state. More specifically, embodiments of the present invention relate to methods and systems for extracting petroleum and/or other hydrocarbons from coal.

2. Description of the Related Art

As coal liquefaction generally is a high-temperature/high-pressure process, it requires a significant energy consumption and, at industrial scales (thousands of barrels/day), multi-billion dollar capital investments. Thus, coal liquefaction presents a high investment risk has and has typically only been economically viable at historically high oil prices.

BRIEF DESCRIPTION OF THE SEVERAL VIEWS OF THE DRAWINGS

Embodiments of the present invention are illustrated by way of example, and not by way of limitation, in the figures of the accompanying drawings and in which like reference numerals refer to similar elements and in which.

SUMMARY

Figure 1:
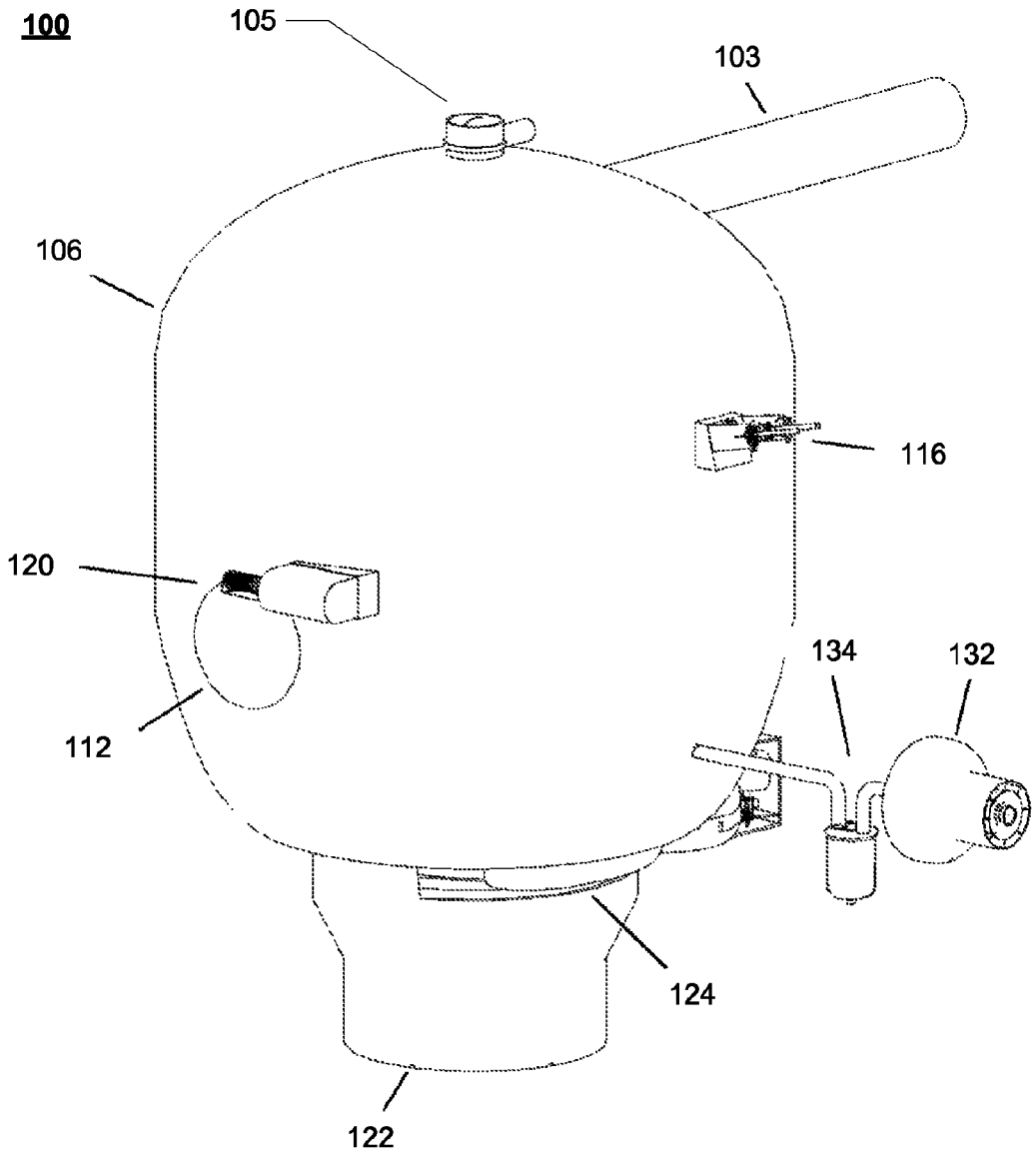
FIG. 1 illustrates a batch processing plasma furnace according to one embodiment of the present invention for extracting desired recoverable materials from source materials.

Systems and methods are described for coal liquefaction. According to one embodiment, coal is introduced into a plasma furnace. A plasma energy field is generated within the plasma furnace by causing an electrical discharge between a pair of arc rods located within the plasma furnace and positioned above the coal. Hydrocarbons contained within the coal are separated from the coal by causing the plasma energy field to penetrate the coal and heat the coal to a temperature sufficient to liquefy the hydrocarbons by focusing and drawing the plasma energy field through the coal with a magnetic field created proximate to the coal. The liquefied hydrocarbons are then captured.

DETAILED DESCRIPTION

Systems and methods are described for extracting recoverable materials (e.g., petroleum and/or other hydrocarbons) from source materials (e.g., tar sands). According to one embodiment a Plasma Oil Recovery from Tar Sands (PORTS) system is described that utilizes a hot plasma energy field to penetrate tar sands introduced into a plasma furnace. In various embodiments, the PORTS system uses no water, therefore making it very environmentally friendly. Instead the PORTS system utilizes a hot plasma energy field that penetrates the tar sands. This hot electrostatic-charged-molecule-separating-medium virtually boils off the oil from the tar sands.

As described further below, in one embodiment of a first configuration of a PORTS system, a tar sands pump forces tar sands into a crucible within a plasma furnace. Once the crucible is filled to the desired level, a vacuum pump removes all the air from within the plasma furnace, arc rods are positioned over the crucible and ignited with an arc of electricity to generate a plasma energy field. A Faraday coil energizes drawing heat and electrostatic energy down over every tar sand particle. The energy created by the plasma field vaporizes the bitumen clinging to the clay/gravel/sand mixture and forms a cloud within the plasma furnace's interior. The bitumen cloud can then be captured for further processing by opening a vacuum valve at the top of the plasma furnace. After the bitumen has been released from the clay/gravel/sand mixture, a disposal vacuum gate at the furnace's bottom opens as the crucible is mechanically turned over and the bitumen free mixture falls through the opening for removal. Once the bottom vacuum gate valve is sealed securely, the process can be repeated. The top valve is sealed and the vacuum pumps remove the air inside the furnace. The arc rods move over the crucible and ignite with an arc of electricity. The surrounding vacuum is energized and a ball of plasma energy is created. The Faraday Coil energizes drawing heat and electrostatic energy down over every tar sands particle and the bitumen is freed becoming a vapor cloud to be removed for processing.

As described further below, in one embodiment of a second configuration of a PORTS system, continual tar sands processing is provided by extruding pre-heated malleable tar sands down a long tray running through a plasma furnace. The tar sands slide along the open faced tray while being heated and energized by Faraday coils running beneath the tray. Heat and energy together create magnetic fields which draw plasma energy created by plasma arcs above the open-faced tray to harness the plasma field energy to heat the tar sands and create a vapor cloud of bitumen oil. Then, bitumen condensing on the interior walls of the cylindrical plasma furnace is collected by either a large doughnut shaped piston moving backward and forward through the plasma furnace or a forward turning doughnut shaped screw. As the tar sands travel through the length of the open-faced tray it eventually dries out and turns to powdery soil which empties into an augured collection pipe.

In the following description, for the purposes of explanation, numerous specific details are set forth in order to provide a thorough understanding of embodiments of the present invention. It will be apparent, however, to one skilled in the art that embodiments of the present invention may be practiced without some of these specific details.

Embodiments of the present invention include various steps, which will be described below. The steps may be performed by hardware components or may be embodied in machine-executable instructions, which may be used to cause a general-purpose or special-purpose processor programmed with the instructions to perform the steps. Alternatively, the steps may be performed by a combination of mechanical means, electro-mechanical means, hardware, software, firmware and/or by human operators.

Embodiments of the present invention may be provided as a whole or in part as a computer program product, which may include a machine-readable storage medium tangibly embodying thereon instructions, which may be used to program a computer (or other electronic devices) to perform a process. The machine-readable medium may include, but is not limited to, fixed (hard) drives, magnetic tape, floppy diskettes, optical disks, compact disc read-only memories (CD-ROMs), and magneto-optical disks, semiconductor memories, such as ROMs, PROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e.g., computer programming code, such as software or firmware). Moreover, embodiments of the present invention may also be downloaded as one or more computer program products, wherein the program may be transferred from a remote computer to a requesting computer by way of data signals embodied in a carrier wave or other propagation medium via a communication link (e.g., a modem or network connection).

In various embodiments, the article(s) of manufacture (e.g., the computer program products) containing the computer programming code may be used by executing the code directly from the machine-readable storage medium or by copying the code from the machine-readable storage medium into another machine-readable storage medium (e.g., a hard disk, RAM, etc.) or by transmitting the code on a network for remote execution. Various methods described herein may be practiced by combining one or more machine-readable storage media containing the code according to the present invention with appropriate standard computer hardware to execute the code contained therein. An apparatus for practicing various embodiments of the present invention may involve one or more computers (or one or more processors within a single computer) and storage systems containing or having network access to computer program(s) coded in accordance with various methods described herein, and the method steps of the invention could be accomplished by modules, routines, subroutines, or subparts of a computer program product.

Importantly, while, for brevity, embodiments of the present invention are described with respect to extracting bitumen from tar sands, those skilled in the art will understand the extraction principles are broadly applicable to other source materials, including, but not limited to complex or refractory ores, crude oil, tar sands, shale, coal, granite and the like.

Terminology

Brief definitions of terms, abbreviations, and phrases used throughout this application are given below.

The terms 'connected' or 'coupled' and related terms are used in an operational sense and are not necessarily limited to a direct physical connection or coupling. Thus, for example, two devices may be couple directly, or via one or more intermediary media or devices. As another example, devices may be coupled in such a way that information can be passed there between, while not sharing any physical connection on with another. Based on the disclosure provided herein, one of ordinary skill in the art will appreciate a variety of ways in which connection or coupling exists in accordance with the aforementioned definition.

The phrases 'in one embodiment,' 'according to one embodiment,' and the like generally mean the particular feature, structure, or characteristic following the phrase is included in at least one embodiment of the present invention, and may be included in more than one embodiment of the present invention. Importantly, such phases do not necessarily refer to the same embodiment.

If the specification states a component or feature 'may', 'can', 'could', or 'might' be included or have a characteristic, that particular component or feature is not required to be included or have the characteristic.

The term 'responsive' includes completely or partially responsive.

The term 'source materials' generally refers to complex or refractory ores, crude oil, tar sands, shale, coal, granite and the like.

FIG. 1 illustrates a batch processing plasma furnace 106 according to one embodiment of the present invention for extracting desired recoverable materials from source materials. Plasma furnace 106 represents a reactor chamber for carrying out processes in accordance with an embodiment of the present invention. The system 100 further includes a vacuum system 132 and 134 for obtaining the desired vacuum pressure where the vacuum system may be connected to a computer controller means for selectively controlling the pressure in the reactor 106. The vacuum system 132 and 134 include at least one of the following roughing pumps, turbo pumps, diffusion pumps, turbo molecular pumps and the like, any combination of pumps may be utilized together or independently. The pump 132 is connected to the plasma furnace 106 via vacuum pump coil 134 to maintain a vacuum.

Figure 2:
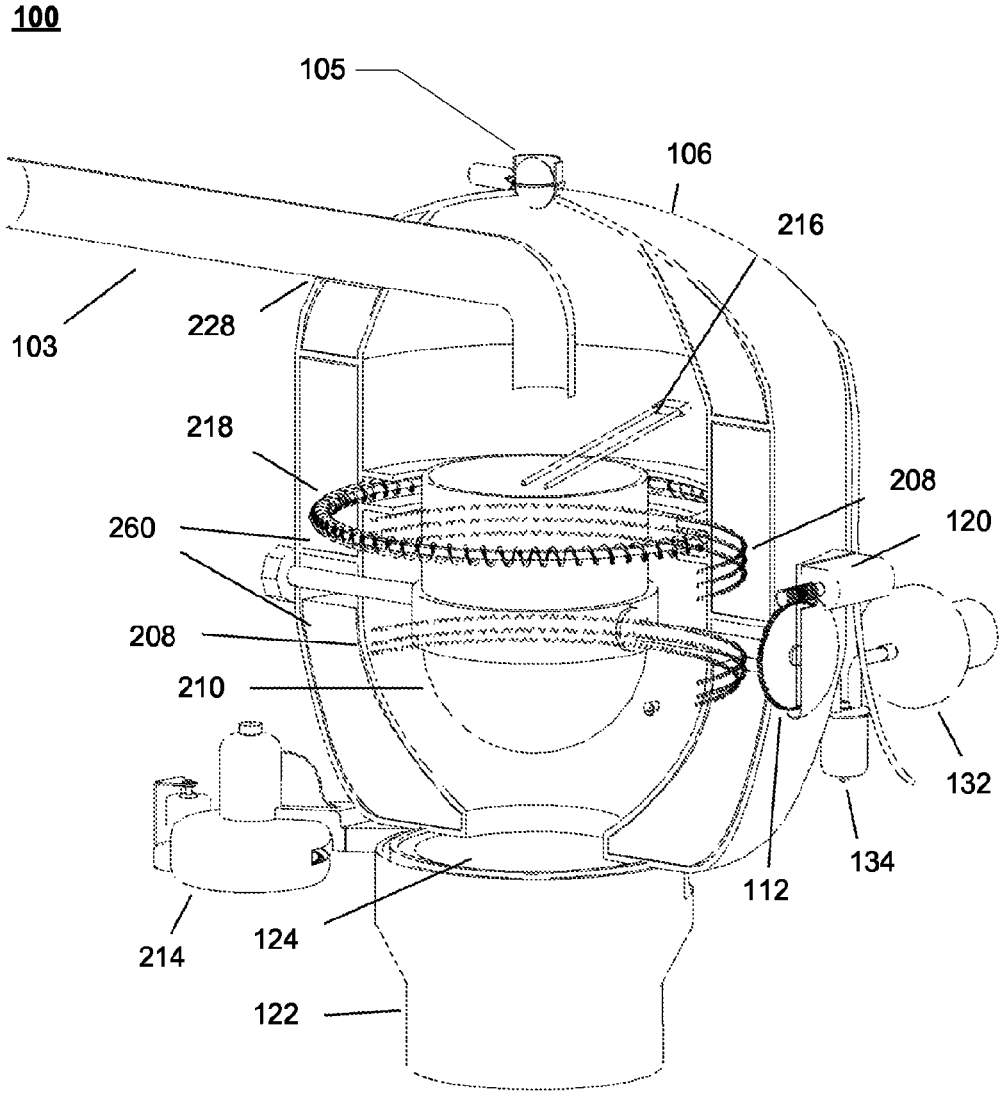
FIG. 2 is a cut away diagram of the plasma furnace of FIG. 1.
Figure 3:
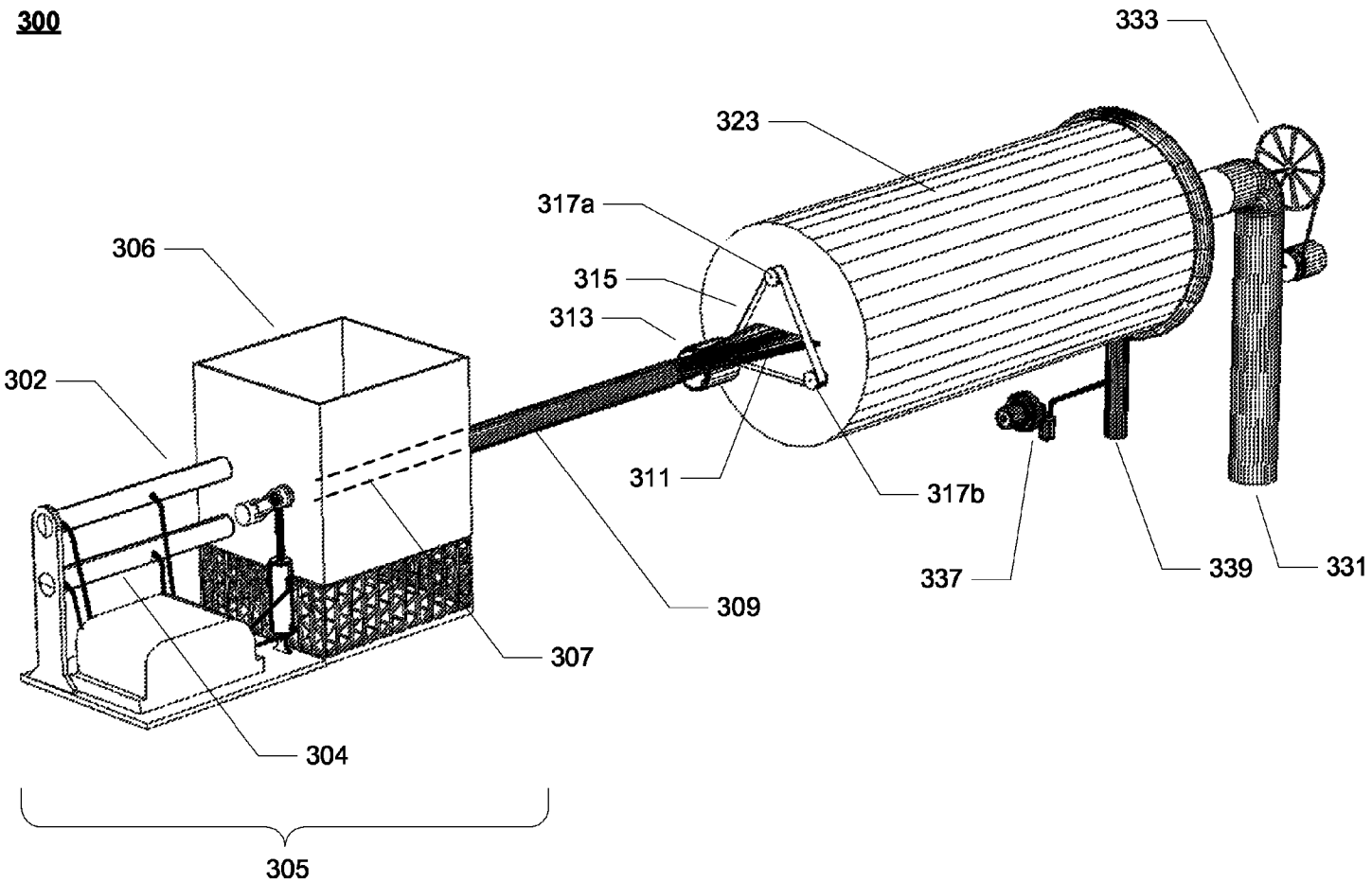
FIG. 3 is a three quarter view of a continual processing extraction system according to an alternative embodiment of the present invention.
Figure 4:
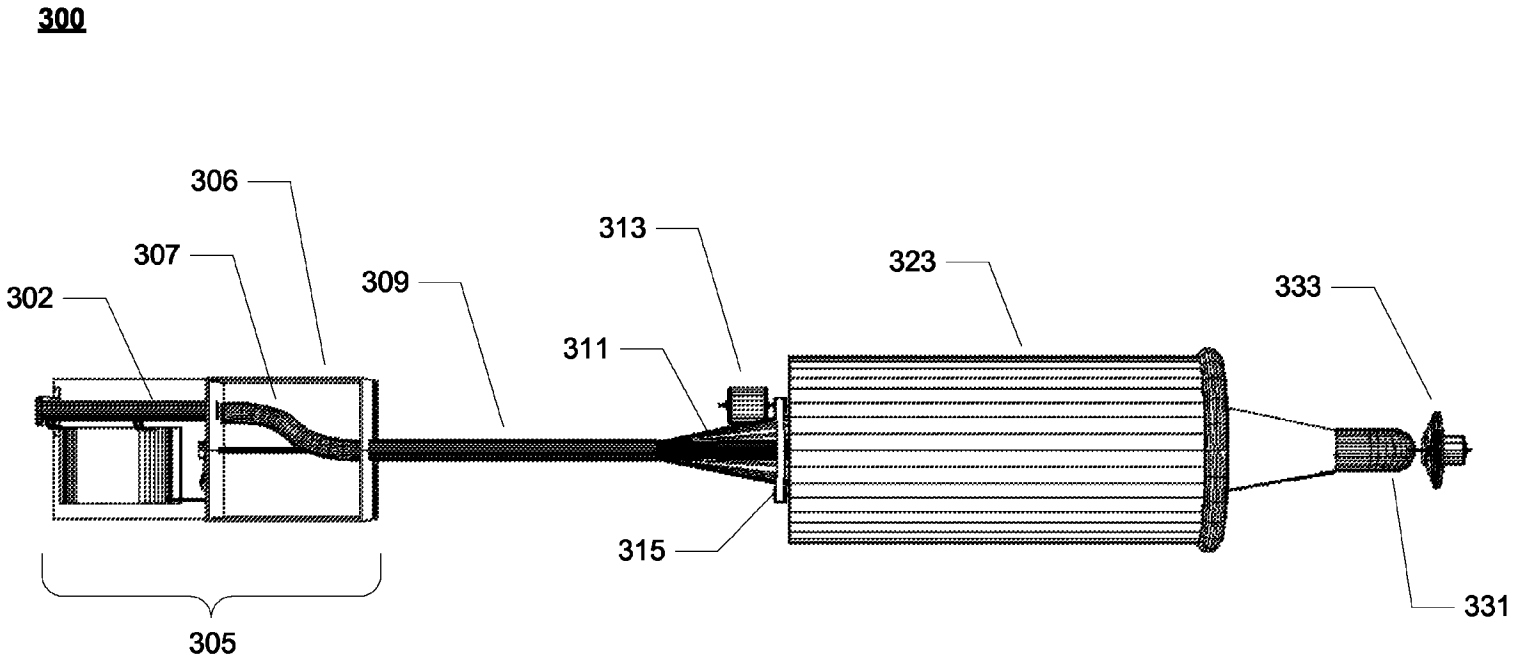
FIG. 4 is a top view of the continual processing extraction system of FIG. 3.
Figure 5:
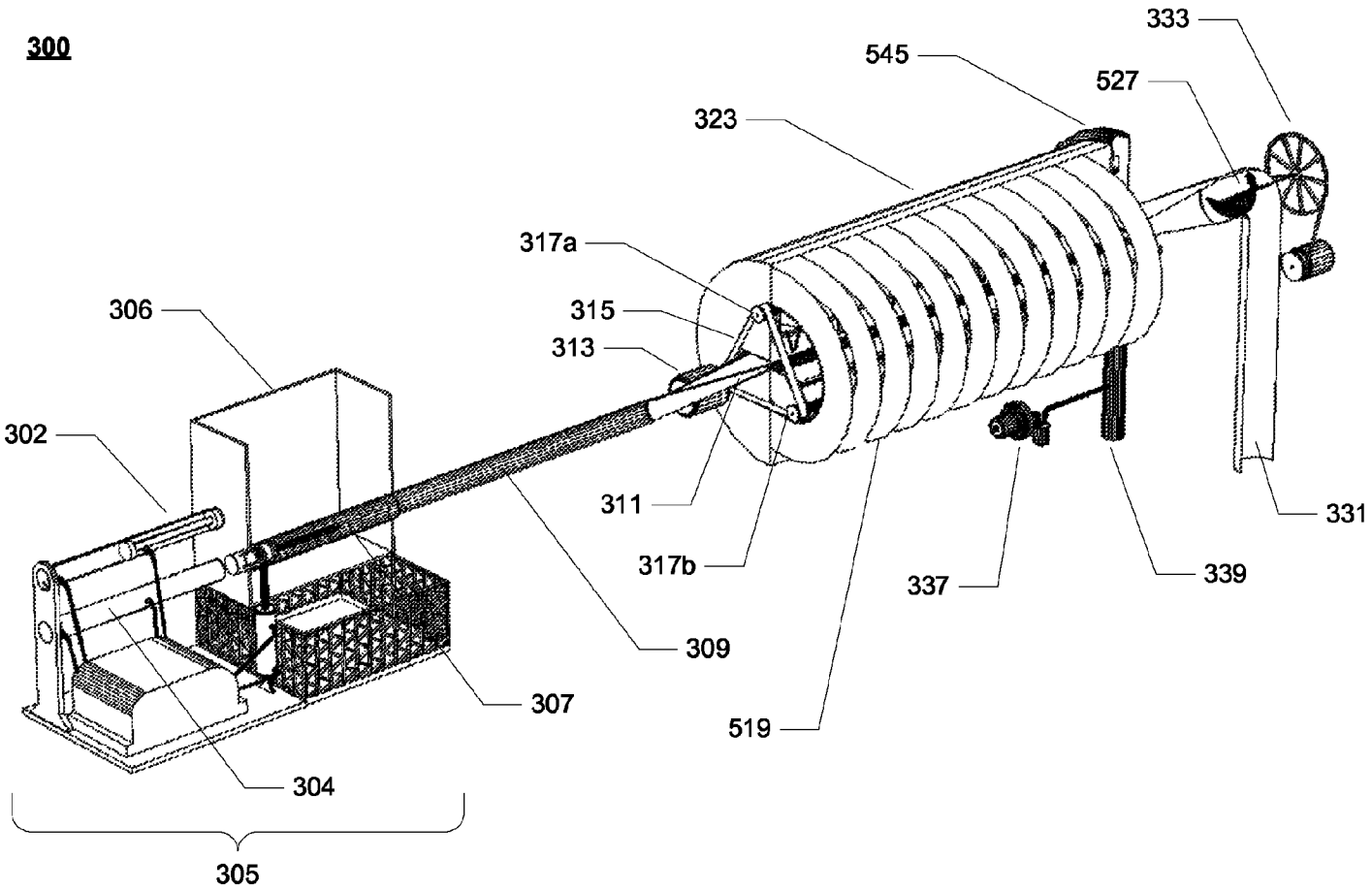
FIG. 5 is a three quarter half cut view of the continual processing extraction system of FIG. 3.

FIG. 2 is a cut away diagram of the plasma furnace 106 of FIG. 1. Inside the plasma furnace 106, a crucible 210 is used to contain the source materials. The crucible 210 can have a large volume capable of processing at least one (1) and up to two point five (2.5) tons of material per batch processing. For example, the volume of the crucible 210 may be in the range from about 100-1000 $ft^3$. The plasma furnace 106 has at least two openings, a top opening 228 and a bottom opening 124. The tailings dump pipe 122 attaches to the bottom of the plasma furnace 106.

The source materials for processing enter the plasma furnace 106 via pipe 103. The means for introducing the materials to the depressurized chamber can be any number of methods. In one embodiment its can be a batch process that includes a hopper (not shown) for materials that are cyclically depressurized. In another embodiment, the process can involve a continuous feed system that allows materials to pass into the depressurized hopper. Similarly, the output can have a batch or continuous system.

The crucible 210 is attached to a large gear 112 for dumping the contents down dump pipe 122. The worm gear 120 turns the large gear for dumping crucible 210 slowly.

Plasma rods 216 (e.g., an anode and cathode assembly) for generating plasma are inserted into the plasma furnace 106 at a suitable position. The position of the assembly 216 can be optimized for plasma production. The assembly can include an insertion and withdrawal to allow for control and to avoid damage during dumping of the crucible 210.

The cross section of the chamber 106 shows refractory cement, which can be used to provide thermal insulation of the heat from the plasma.

Referring to the interior of the plasma furnace 106 and receptacle 210 for holding the source material to be processed. The receptacle 210 may include any combination of a container coated in a ceramic material, a solid ceramic container or any other container capable of withstanding the severe heat and process operating conditions. The receptacle 210 is heated by a heating means 208 (e.g., heating coils) for processing the loading material to a desired temperature.

The heating means 208 may include inductive coils, resistive coils or other suitable heating mechanism. Additionally, any combination of the foregoing heating means is also contemplated, for example, having inductive coils and resistive coils as the heating means. For example, the heating means 208 may include 2 to 4 inductive coils arranged around the receptacle means 210. According to one embodiment, one primary coil and one standby booster coil are used. Finally, the heating means 208 may be computer controlled by a controller means.

Referring to FIG. 1 and FIG. 2, the receptacle means 210 may include a magnetic means 218 (e.g., a Faraday coil) arranged on the outside of the receptacle means 210 for creating a magnetic field thereby promoting ionization. The magnetic means 218 provides confinement of electrons (along the magnetic field lines) thereby promoting a stable plasma around the receptacle means 210. The magnetic means 218 may be arranged to form a three-dimensional area surrounding the receptacle means 210.

In addition, referring to FIG. 2 any number of magnetic field arrangements have been contemplated and may be utilized. For example, a first ring of individual magnets may be arranged in magnetic holders with their N-S polarities pointing in the same direction. While, a second ring of magnets are arranged below the first ring of magnets with their N-S polarities pointing in the same direction as the first ring of magnets. This configuration promotes a magnetic field into and around the receptacle means 10. Any number of magnetic holders and magnets may be utilized.

Alternatively, an arrangement of magnets having a distorted magnetic field may also be utilized. For example, a first ring of magnets having N-S polarities pointing in the same direction. While, a second ring of magnets are arranged under the first ring of magnets having their polarities pointing in an opposite direction, when compared to first series of magnets. Accordingly, a distorted magnetic field is formed around the receptacle means 210. Any number of magnet field configurations maybe utilized for promoting beneficial plasma around the receptacle means 210. In addition, an electrical magnetic field generating means and/or a combination of magnets with electrical magnetic field generator means may also be utilized to form the magnetic fields.

Referring to FIG. 1, the receptacle means 210 is designed for receiving the source material to be processed and may hold approximately one (1) ton to two point two (2.2) tons of material to be processed. The receptacle 210 maybe surrounded by a heating means 208 that is connected to a power supply means for heating the material to a desired temperature. The power supply means may include a high voltage generator, RF generator, and the like. Additionally, the power supply means maybe connected to a computer controller means. For example, the power supply means may be connected to inductive coils, resistive heaters, and/or other conventional heaters. Additionally, the receptacle means 210 may be RF biased thereby promoting a bombardment of ionic flux onto the receptacle means 210.

Further referring to FIG. 2, a movable pair of plasma rods 216 is arranged above the receptacle means 210. In one embodiment, the cathode may be cooled with a cooling apparatus and connected to cooling plate for receiving deposits from the vapor phase. The cooling apparatus may include a heat exchanger and recirculating pipes. Any suitable fluid having the appropriate heat transfer properties may be used by the heat exchanger, for example, water and the like.

Optionally, the cathode and the cooling plate may be different geometric shapes or any combination of geometric shapes. For example, the cathode and cooling plate can be square, a diamond, a rectangle, a triangle, a hexagon, an octagon, and a pentagon. By utilizing the different shapes selective deposition onto the cooling plate can be accomplished.

At a predetermined time during the process, the plasma rods 216 may be turned clockwise or counter-clockwise or may move horizontally in and out of the plasma furnace 106. For example, while loading the receptacle means 210 the plasma rods 216 may be retracted. When turning the cathode at different time intervals selective deposition onto the cooling plates is possible. As the desired recoverable materials have different thermodynamic properties, separation occurs at different times, therefore, at first time interval a first material may be deposited onto the cooling plate in a first position. At a second time after turning the cooling plate to a second position, a second material may be deposited on the cooling plate's second position and a third material may be deposited on the cooling plate's third position, and so forth.

In one embodiment, once the bitumen is vaporized the oil-bearing cloud inside the plasma furnace 106 may be siphoned off through a pipe gate valve opening 105 at the top of the plasma furnace 106.

In operation, according to one embodiment, as the tar sands are pumped into the crucible 210 for heating, air is pumped out of the interior of the plasma furnace 106 to form a vacuum. The Faraday coil 218 surrounding the crucible 210 draws down and focuses the plasma's energy thus thoroughly engulfing each tar sand particle. As the Faraday coil 218 energizes the two arc rod electrodes 216 are extended down into and over the crucible 210. High-voltage electrical current from these rods energize to create the high-temperature, low-cost plasma field.

According to one embodiment, clamps (not shown) on either side of the electrodes 216 releases either rod independently, in the case that one rod burns faster than its companion these clamps allow for fine adjusts to lengthening position and quick, easy removal and replacement of the arc rods 216. Typically resistance, amperage control, and heat determine when the arc rod stepper motor engages. The anode and cathode rods 216 can be moved accurately down into the crucible 210 and back out again using friction from shaped top and bottom rubber-metal cylinders, for example.

According to one embodiment, after the bitumen is released from the rock mixture it is forced up and out through the pipe gate valve 105 on the top of the furnace for processing. The large vacuum gate valve 124 at the bottom of the furnace opens. The arc rods 216 are then withdrawn and the high torque worm gear 120 turns the crucible 210 over so the dry powdery tailings can be removed. The worm drive forces the crucible axels, along with the crucible 210 to dump its load of dry dirt. Finally, the lower vacuum-gate valve may be closed allowing the process to begin again.

The plasma furnace 106 may also have a number of heating sensors (not shown) selectively arranged within the interior and exterior of the plasma furnace 106. These heating sensors may include, for example, thermocouples, thermometers, pyrometers, and other heat measuring devices. For example, thermocouples may be arranged on the skin of the plasma furnace 106, the outer skin of the receptacle 210 and/or the cooling loop.

The plasma furnace 106 may also include optical sensors (not shown) for determining the color of the plasma and these sensors maybe connected to computer controllers. The sensors may also include various different color filters, infrared sensors, CCDS and the like. For example, an optical sensor coupled to a pyrometer and CCDS could transmit a video signal to a video monitor a digital temperature read out and a color sensor. The video monitor would allow an operator, for example, to determine visually that the system is operating in an optimal mode while the digital temperature read out and the color sensor send digital information to the analytical computer which communicates with the machine computer allowing the system computer to control the process.

Optionally, the sensors may be calibrated and connected to the computer controller for monitoring the wavelengths and changes of wavelengths emitted by the plasma. It has been found that the wavelength of the plasma can be correlated with the type of source material being processed. Therefore, by using a series of feedback controllers connected the computer controller selective material recovery is possible.

In addition, by utilizing the sensors, the processing time of any batch of material can be reduced—as the sensors can be configured to find a particular type of desired recoverable material. For example, the sensors and the process may be calibrated to recover a specific material. By monitoring the color of the plasma, utilizing feed back controllers and the computer controllers the process can be adjusted in real time to maximize the recovery of a predetermined or selected material. Accordingly, the process time may be shortened and the overall throughput of the process becomes more efficient.

An alternative embodiment, providing for continual processing of source materials will now be described with reference to FIG. 3 through FIG. 8. In the context of the present example, the system 300 is described in connection with a process for removing bitumen from tar sands.

In the present example, the system includes a tar sands pump 305 and a plasma furnace 323. In one embodiment, the plasma furnace 323 is corrugated on the outside for strength and is smooth on the inside for oil vapor condensation. Tar sands are delivered from the tar sands pump 305 to the plasma furnace 323 via tar sands pump pipe 309, which may be made of high-pressure steel or the like.

In one embodiment, the tar sands pump 305 is a cement pump and includes a pair of hydraulic or pneumatic pistons 302 and 304 and a tar sands loading bin 306. The pistons 302 and 304 are alternately filled with tar sands from the loading bin 306 and pump tar sands into and through an S-curve switching pipe 307 within the loading bin 306. In this manner, continual pumping of tar sands may be accomplished.

According to one embodiment, before the tar sands are introduced into the plasma furnace 323, they are flattened by an extruder pipe 311 to allow proper baking.

Within the plasma furnace 323, the flattened tar sands are pushed along a tray 625 (see FIG. 6) that travels through an interior portion of a large hollow screw 519 (see FIG. 5) that is configured to scrape, move and otherwise clean the condensed bitumen from the interior of the plasma furnace 323 by pushing the condensed bitumen to a bitumen collection lip 545 (see FIG. 5), which leads to a bitumen delivery drain 339 beneath the plasma furnace 323. The screw 519 is turned forward by a planetary gear 753 (See FIG. 7) which is engaged with three drive belt screw gears (e.g., 749*a* and 749*b* (see FIG. 7)).

According to one embodiment, the screw 519 is manufactured of a light weight material (e.g., aluminum cast) to accommodate desired dimensions and throughput of the plasma chamber 323 and provide for a flexible interface to scrape the bitumen vapor from the interior surface walls of the plasma furnace 323. According to one embodiment, the screw 519 may be capped with a carbon fiber material to add strength and flexibility.

In one embodiment, a bitumen collection gutter 621 (see FIG. 6) is formed on within the outer edges of the screw 519. In one embodiment, a block of aluminum is milled to form the scraping edge of the screw 519 and gutter 621 as one. Depending upon cost constraints for the particular implementation other materials may be used.

A suspension bridge 751 (see FIG. 7) within the plasma furnace 323 holds up and positions pairs of arc rods/plasma rods (e.g., 747*a-n* (see FIG. 7)) above the tray 625. In a typical implementation, the suspension bridge 751 is both a non-conductor and heat resistant. The plasma rods 747*a-n* create an energy efficient heat source for vaporizing bitumen contained within the tar sands. A faraday coil 743 (see FIG. 7) is located on the underside of the tray 625 to focus the plasma energy created by the plasma rods 747*a-n* evenly through the tar sands.

In one embodiment, the flexible edges of the screw 519 neatly clean the furnace's cylindrical interior much like using a rubber spatula on a smooth mixing bowl surface.

Whatever small portion of the bitumen vapor does not condense on the interior wall of the plasma furnace 323 can be sucked away down the bitumen oil drain 339 along with the liquid bitumen. Waste gases can be filtered by waste gas filter 337.

In one embodiment, the outer edges of the screw 519 include carbon fiber tips e.g., 841*a-b* (see FIG. 8), for scraping bitumen from the interior wall of the plasma furnace 323. Bitumen collection gutters, e.g., 621*a-b* (see FIG. 8) may also be formed at the outer edges of the screw 519 to drain away oil from the top half of the cylindrical furnace's apex or interior roof. In this manner, oil is prevented from contaminating the tar sand on the tray 625 and the row of arc plasma rods 747*a-b* positioned over the tray 625.

According to one embodiment, the screw 519 turns in one direction only to force the collected vapor bitumen to the front end where it is collected and drained for processing. Friction from such a massive screw can be alleviated in several ways, for example, by having two central located axels at either end or creating a light weight screw wherein the weight of the screw is simply supported by contact with the interior edge. The free oil inside the plasma furnace 323 and the oil condensation act as a protective coating cutting friction by coating the inside with a non-stick oil surface.

A high-torque electric or gas powered motor 313 rotates the large doughnut hole screw 519 by turning a fan belt 315, which drives the three drive belt screw gears (e.g., 749*a* and 749*b*) by driving corresponding gear hubs (e.g., 317*a* and 317*b*). The doughnut hole or screw's interior has a planetary gear 753 (see FIG. 7) at the back end that is turned by the three drive belt screw gears 749.

According to one embodiment, an auger 527 (see FIG. 5), powered by an auger motor drive 333, is provided at the end of the plasma furnace 323 for removing tailings by sending them down a disposal tube 331.

In operation, S-pipe 307 inside tar sands storage bin 306 moves from one piston 302 receptacle to the other 304. As the pistons 302 and 304 draw back, they fill with tar sands and as they push forward the tar sands are forced into the S-pipe 307, then on through to the plasma furnace 323. The bitumen soaked sand, clay and gravel fill the tar sands loading bin 306, then the pistons 302 and 304 pump the tar sands in long tube 309 where it feeds the plasma furnace 323.

According to one embodiment, as the pistons alternate between being pulled back and being pushed forward, the S-pipe 307 is simultaneously hydraulically turned so that it matches the filled piston's receptacle opening. The filled piston moves forward filling the S-pipe 307 allowing tar sands to proceed to the plasma furnace 323. The tar sands are then pumped along pipe 309 leading into the plasma furnace 323. The length of the pipe and the oily texture of the tar sands create a purposeful blockage which acts like a valve allowing the creation of a sustainable vacuum inside the plasma furnace 323.

In one embodiment, the processing of tar sands involves going from tar sand ore that begins in a cylindrical form and is introduced to the plasma furnace as a flattened extruded layer in the form of tar sands paste. In one embodiment, an extruder pipe 311 reinforced with extruder type metal flattens the roundly formed tar sands down to a flat layer for proper backing within the plasma furnace 323. The extruder pipe 311 would typically be formed from a heavy duty metal (e.g., 3/16 inch thick highly polished chrome, stainless steel or the like).

Figure 6:
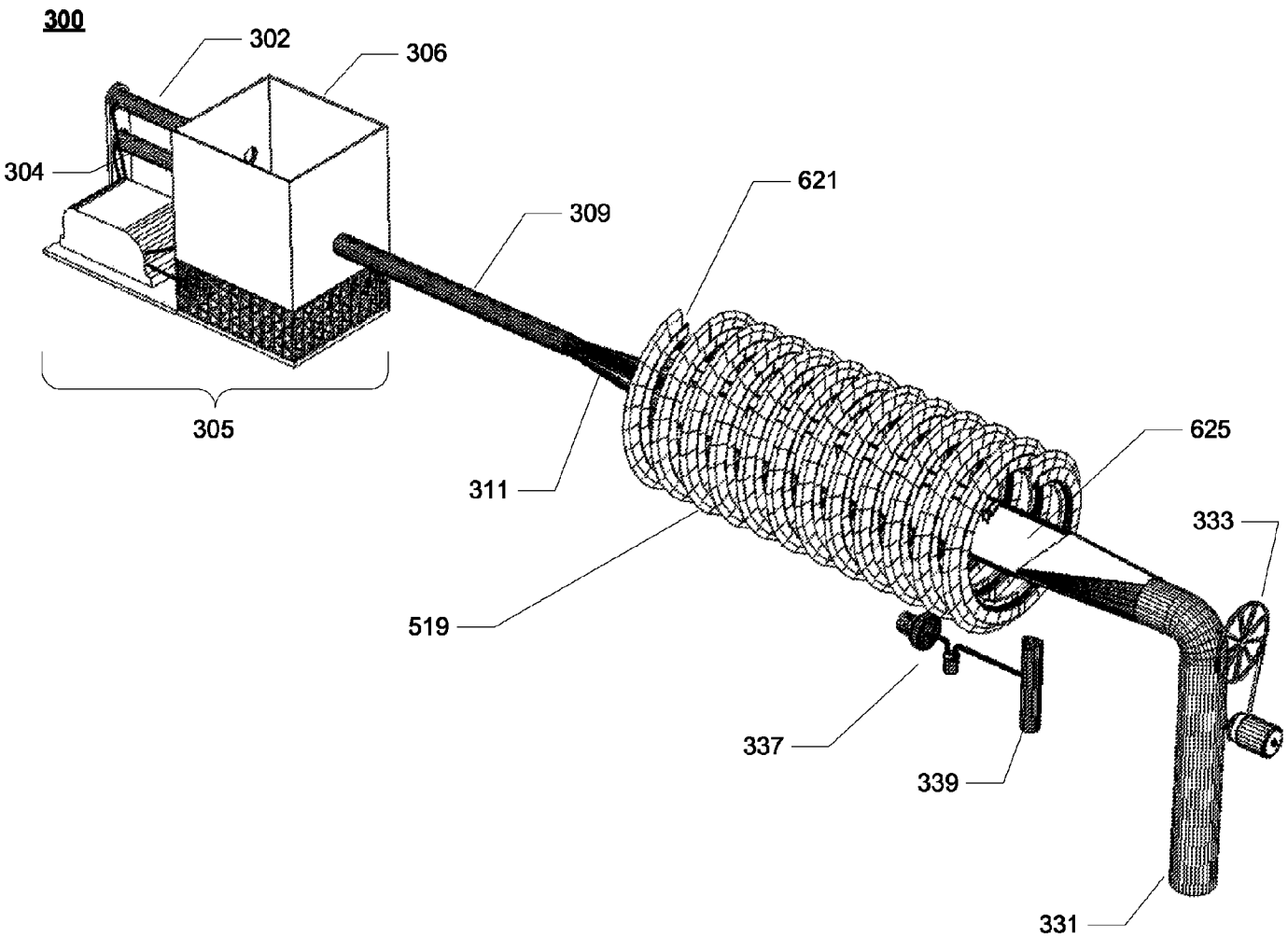
FIG. 6 is a view of continual processing extraction system of FIG. 3 without the plasma furnace wall to expose the internal bitumen condensation collection screw.
Figure 7:
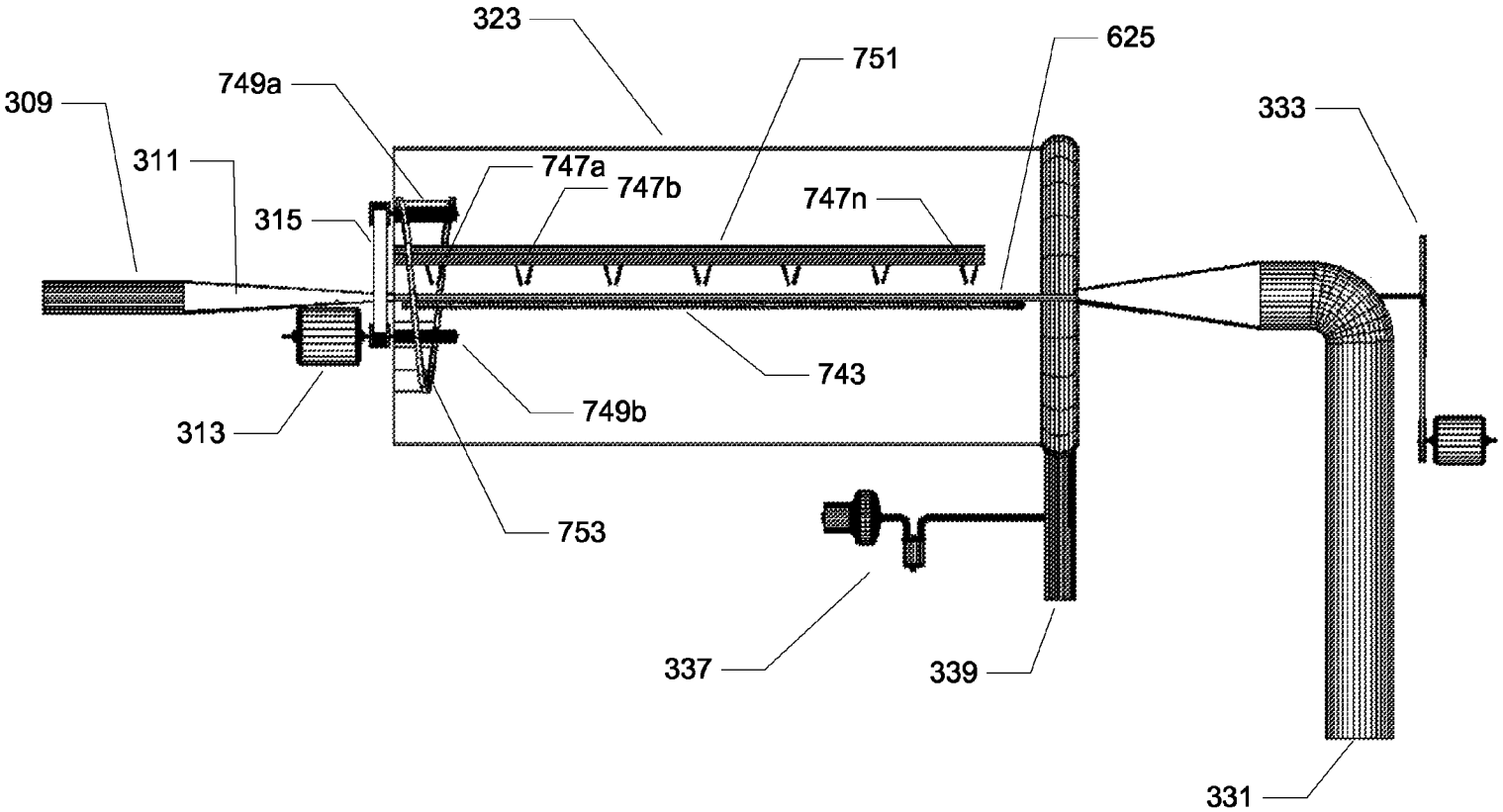
FIG. 7 is a side cut-away view of the plasma furnace of FIG. 3.
Figure 8:
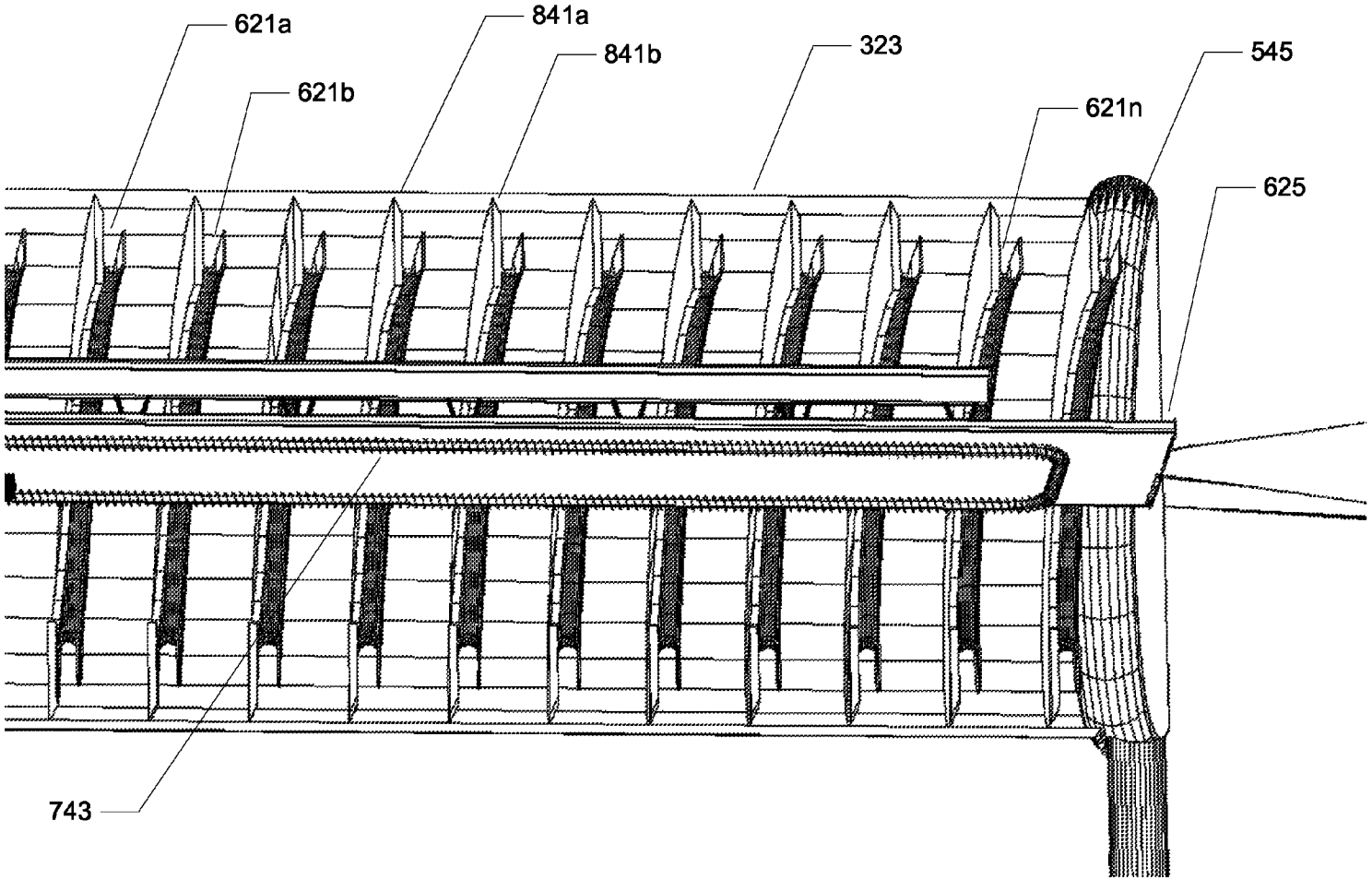
FIG. 8 is a magnified cut-away perspective view of the plasma furnace of FIG. 3.
Figure 9:
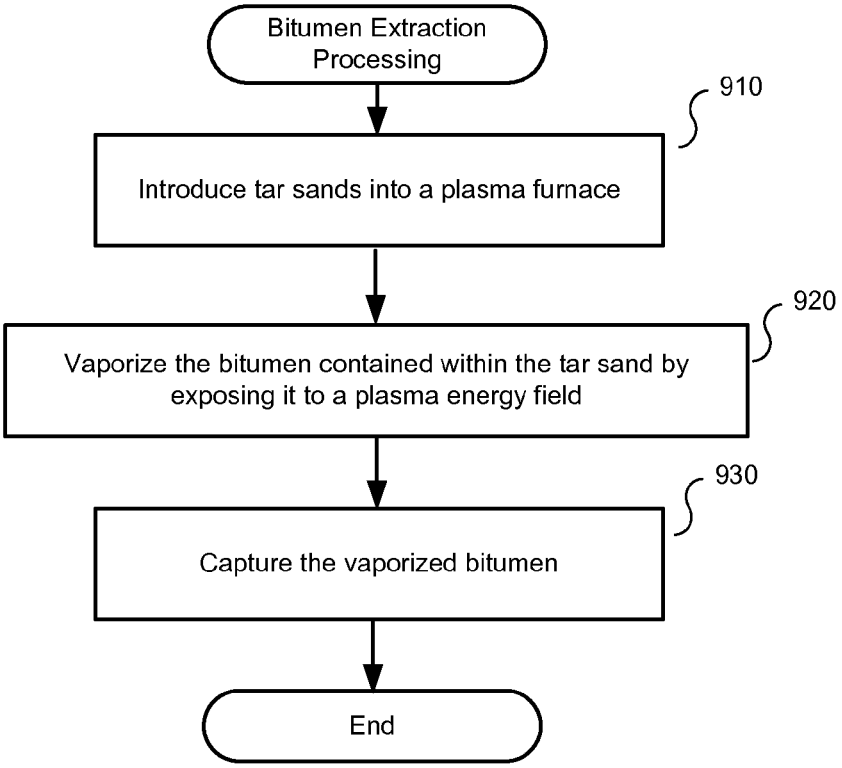
FIG. 9 is a flow diagram illustrating bitumen extraction processing according to one embodiment of the present invention.

After the tar sands is flattened or extruded by extruder pipe 311, the tar sands layer is forced by the pump 305 to continue down the tray 625 (see FIG. 6). In one embodiment, the tray 625 may be tilted down by three to ten degrees to allow gravity to aid in moving the tar sands along. According to one embodiment, the tray 625 is tilted down at a five degree angle.

Depending upon the particular implementation, source materials, desired recoverable materials and processing conditions, the tray 625 could be coated in Teflon. Alternatively, if the heat from plasma rods (e.g., 747*a-n* (see FIG. 7)) would otherwise flake away such a Teflon coating, the tray 625, which is open-faced at the top, could alternatively be constructed of a highly-polished stainless steel or the like.

Heat generated by the plasma rods (e.g., 747*a-n*) and focused down through the tar sands by the Faraday coil 743 (see FIG. 7) thoroughly bake the tar sands at about 400 degrees Celsius and creates a bitumen cloud of vapor which is collected, or condensed on the interior of the plasma furnace 323. The interior surface of the furnace 323 can be coated in Teflon because the temperature, due to the size of the diameter of the plasma furnace, helps cool the vapor for condensation. In alternative embodiments, the interior surface of the plasma furnace 323 is not coated in Teflon as the slippery vapor is a lubricant that helps prevent friction on the surface edge of the screw 519 (see FIG. 5).

According to one embodiment, as the large doughnut hole screw 519 turns, it scrapes the bitumen from the interior walls always moving forward to the collection trough 545.

Advantageously, a continuous bitumen extraction process is thus provided. As long as bitumen-laden material is fed into pump's hopper and continues to move along for extruding, heating, vaporization and disposal, oil production can carry on twenty-four hours a day.

Those skilled in the art will recognize various alternative structures for collecting the condensed bitumen from the surface of the interior walls of the plasma furnace 323. For example, in one alternative embodiment, the long drive screw 519 can be replaced with a large doughnut-shaped piston which moves back and forth pushing/scraping the condensed bitumen from the surface of the interior walls of the plasma furnace 323 into bitumen collection troughs located at both ends of the plasma furnace 323.

Figure 10:
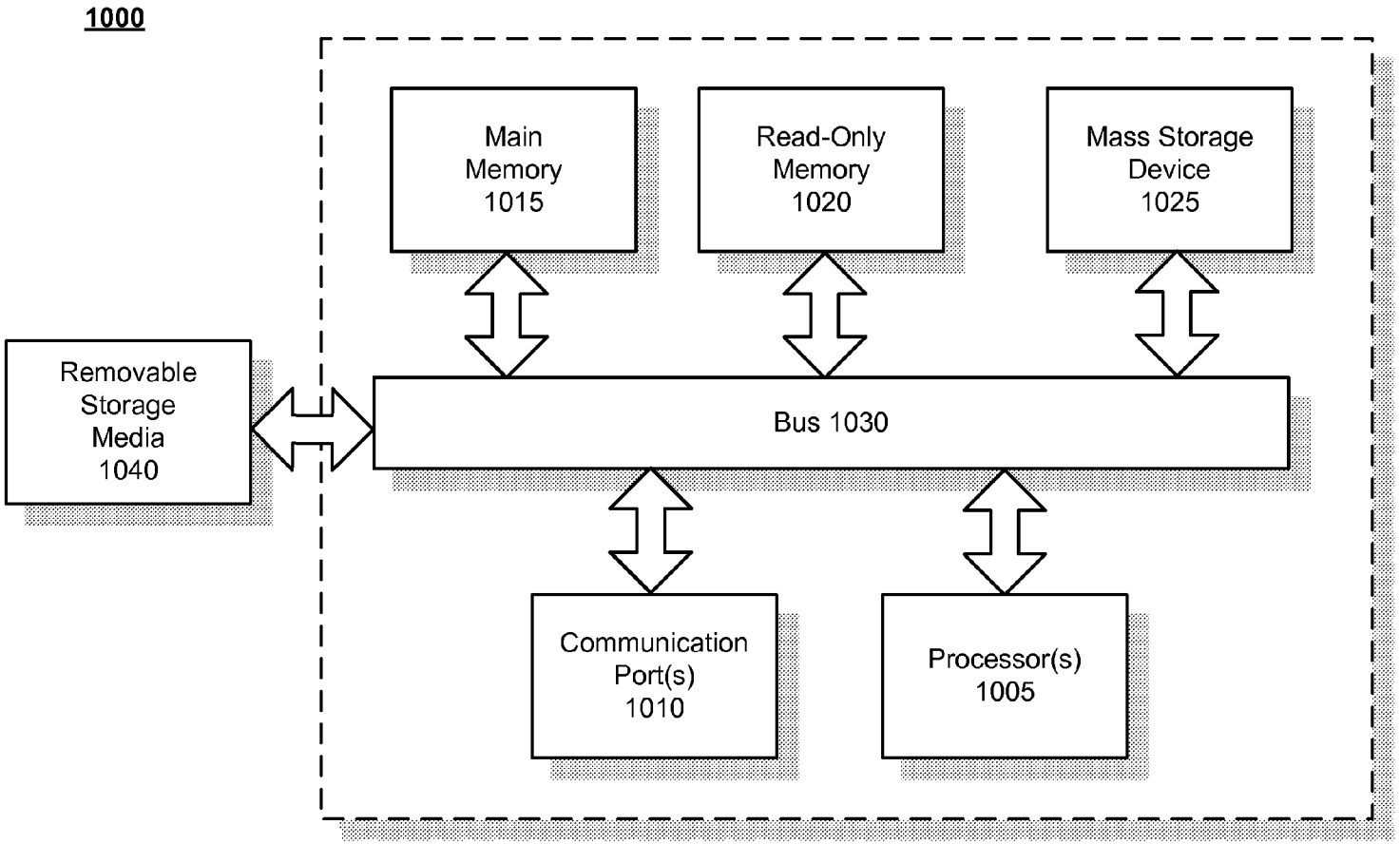
FIG. 10 is an example of a computer system with which embodiments of the present invention may be utilized.

FIG. 10 is an example of a computer system with which embodiments of the present invention may be utilized. Embodiments of the present invention include various steps, which have been described above. A variety of these steps may be performed by hardware components or may be tangibly embodied on a computer-readable storage medium in the form of machine-executable instructions, which may be used to cause a general-purpose processor, special-purpose processor or other computer controller means programmed with instructions to perform these steps. Alternatively, the steps may be performed by a combination of hardware, software, and/or firmware. As such, FIG. 10 is an example of a computer system 1000, such as a workstation, personal computer, laptop, client, server or other computer controller means, upon which or with which embodiments of the present invention may be employed.

According to the present example, the computer system includes a bus 1030, one or more processors 1005, one or more communication ports 1010, a main memory 1015, a removable storage media 1040, a read only memory 1020 and a mass storage 1025.

Processor(s) 1005 can be any future or existing processor, including, but not limited to, an Intel® Itanium® or Itanium 2 processor(s), or AMD®, Opteron® or Athlon MP® processor(s), or Motorola® lines of processors. Communication port(s) 1010 can be any of an RS-232 port for use with a modem based dialup connection, a 10/100 Ethernet port, a Gigabit port using copper or fiber or other existing or future ports. Communication port(s) 1010 may be chosen depending on a network, such a Local Area Network (LAN), Wide Area Network (WAN), or any network to which the computer system 1000 connects.

Main memory 1015 can be Random Access Memory (RAM), or any other dynamic storage device(s) commonly known in the art. Read only memory 1020 can be any static storage device(s) such as Programmable Read Only Memory (PROM) chips for storing static information such as start-up or BIOS instructions for processor 1005.

Mass storage 1025 may be any current or future mass storage solution, which can be used to store information and/or instructions. Exemplary mass storage solutions include, but are not limited to, Parallel Advanced Technology Attachment (PATA) or Serial Advanced Technology Attachment (SATA) hard disk drives or solid-state drives (internal or external, e.g., having Universal Serial Bus (USB) and/or Firewire interfaces), such as those available from Seagate (e.g., the Seagate Barracuda 7200 family) or Hitachi (e.g., the Hitachi Deskstar 7K1000), one or more optical discs, Redundant Array of Independent Disks (RAID) storage, such as an array of disks (e.g., SATA arrays), available from various vendors including Dot Hill Systems Corp., LaCie, Nexsan Technologies, Inc. and Enhance Technology, Inc.

Bus 1030 communicatively couples processor(s) 1005 with the other memory, storage and communication blocks. Bus 1030 can include a bus, such as a Peripheral Component Interconnect (PCI)/PCI Extended (PCI-X), Small Computer System Interface (SCSI), USB or the like, for connecting expansion cards, drives and other subsystems as well as other buses, such a front side bus (FSB), which connects the processor(s) 1005 to system memory.

Optionally, operator and administrative interfaces, such as a display, keyboard, and a cursor control device, may also be coupled to bus 1030 to support direct operator interaction with computer system 1000. Other operator and administrative interfaces can be provided through network connections connected through communication ports 1010.

Removable storage media 1040 can be any kind of external hard-drives, floppy drives, IOMEGA® Zip Drives, Compact Disc-Read Only Memory (CD-ROM), Compact Disc-Re-Writable (CD-RW), Digital Video Disk-Read Only Memory (DVD-ROM).

Components described above are meant only to exemplify various possibilities. In no way should the aforementioned exemplary computer system limit the scope of the invention.

What is claimed is:

1. A method of coal liquefaction comprising:

introducing coal into a plasma furnace;

generating a plasma energy field within the plasma furnace by causing an electrical discharge between a pair of arc rods located within the plasma furnace and positioned above the coal;

separating hydrocarbons contained within the coal by causing the plasma energy field to penetrate the coal and heat the coal to a temperature sufficient to liquefy the hydrocarbons by focusing and drawing the plasma energy field through the coal with a magnetic field created proximate to the coal; and capturing the liquefied hydrocarbons.

2. The method of claim 1, further comprising creating the magnetic field by energizing a faraday coil located within the plasma furnace.

3. The method of claim 1, wherein said introducing the coal into a plasma furnace comprises loading approximately between 1 ton and 2.5 tons of coal into a crucible within the plasma furnace.

4. The method of claim 3, further comprising batch processing successive batches of coal by removing coal tailings and repeating said steps of introducing the coal, generating a plasma energy field, separating hydrocarbons and capturing the liquefied hydrocarbons.

5. The method of claim 1, further comprising:

pre-heating and extruding the coal before introducing the coal into the plasma furnace; and causing the pre-heated and extruded coal to slide along an open-faced tray extending through the plasma furnace.

6. The method of claim 5, wherein the open-faced tray is tilted down by an angle of approximately 3 to 10 degrees and wherein said causing the pre-heated and extruded coal to slide along an open-faced tray extending through the plasma furnace comprises allowing gravity to aid in moving the coal along the open-faced tray.

7. The method of claim 6, further comprising supporting continuous processing of coal by removing coal tailings, continuously retrieving coal from a storage bin and repeating said steps of introducing the coal, generating a plasma energy field, separating hydrocarbons and capturing the liquefied hydrocarbons.

8. The method of claim 1, further comprising removing air from within the plasma furnace with a vacuum pump.

9. The method of claim 1, further comprising pre-processing the coal prior to said introducing the coal into the plasma furnace.

* * * * *